US006751812B2

(12) United States Patent
Malloy

(10) Patent No.: US 6,751,812 B2
(45) Date of Patent: Jun. 22, 2004

(54) CLOSET FLANGE

(75) Inventor: Mark B. Malloy, 814 Dawes, Joliet, IL (US) 60435

(73) Assignee: Mark B. Malloy, Joliet, IL (US)

( * ) Notice: Subject to any disclaimer, the term of this patent is extended or adjusted under 35 U.S.C. 154(b) by 0 days.

(21) Appl. No.: 10/223,724

(22) Filed: Aug. 20, 2002

(65) Prior Publication Data

US 2004/0034907 A1 Feb. 26, 2004

(51) Int. Cl.[7] ..... E03D 11/17
(52) U.S. Cl. ..... 4/252.4; 4/252.1; 4/252.5
(58) Field of Search ..... 4/252.1, 252.6; 285/56–60

(56) References Cited

U.S. PATENT DOCUMENTS

| | | | | | |
|---|---|---|---|---|---|
| 2,837,750 | A | * | 6/1958 | Robinson | 4/252.5 |
| 3,419,288 | A | * | 12/1968 | Logsdon | 285/58 |
| 3,643,267 | A | * | 2/1972 | Winter | 4/252.4 |
| 3,967,326 | A | * | 7/1976 | Tammen | 4/252.5 |
| 4,730,854 | A | * | 3/1988 | Cuschera | 285/42 |
| 5,018,224 | A | * | 5/1991 | Hodges | 4/252.6 |
| 5,115,554 | A | * | 5/1992 | Fell, Sr. | 4/252.4 |
| 5,996,134 | A | * | 12/1999 | Senninger | 4/252.4 |
| 6,085,362 | A | * | 7/2000 | Huber | 4/252.4 |
| 6,254,141 | B1 | * | 7/2001 | Piper | 285/56 |
| 6,354,058 | B1 | * | 3/2002 | Lewis | 52/749.11 |
| 6,408,584 | B1 | * | 6/2002 | Rodriguez | 52/390 |
| 6,443,495 | B1 | * | 9/2002 | Harmeling | 285/56 |
| 6,598,241 | B1 | * | 7/2003 | Williams | 4/252.1 |
| 2003/0093855 | A1 | * | 5/2003 | Rendell | 4/252.4 |

* cited by examiner

*Primary Examiner*—Henry Bennett
*Assistant Examiner*—Amanda Flynn
(74) *Attorney, Agent, or Firm*—Toler, Larson & Abel, LLP

(57) ABSTRACT

A closet flange for installing a bathroom commode, comprising an integrally formed unit having an upper flange, a cylindrical section extending downwardly therefrom for connection to a waste water discharge conduit, and a through passageway extending through the unit, wherein the upper flange has a sufficient thickness or vertical dimension to lie in the same plane as the finish tile floor surface when the closet flange has been bolted in place to the base floor above which a tile supporting underlayment has been installed with the finish tile floor installed over the supporting underlayment. No washers or other shim materials are needed to bring the upper surface of the flange in accordance with this invention into planar alignment with or above the surface of the finish tile floor.

18 Claims, 3 Drawing Sheets

CLOSET FLANGE

FIELD OF THE INVENTION

This invention relates to the field of closet flanges used to secure and support toilet appliances commonly known as water closets or commodes on bathroom floors, and in particular to one in which the upper surface of the flange is slightly above in accordance with this invention when finally installed.

BACKGROUND OF THE INVENTION

Presently existing closet flanges known to the prior art do not have their upper surfaces level with the finished floor or slightly above when finally installed unless linoleum flooring is used, but below the level of the finished floor when ¾ inch hardwood floors are laid or tile with ⅜ inch or ½ inch Durrock type material is used.

SUMMARY OF THE INVENTION

The present invention solves this problem with prior art closet flanges by providing a flange having a vertical dimension or thickness that is sufficient to reach the level of the bathroom floor when the closet flange unit in accordance with this invention is installed.

DESCRIPTION OF PREFERRED EMBODIMENT

Figure 1:
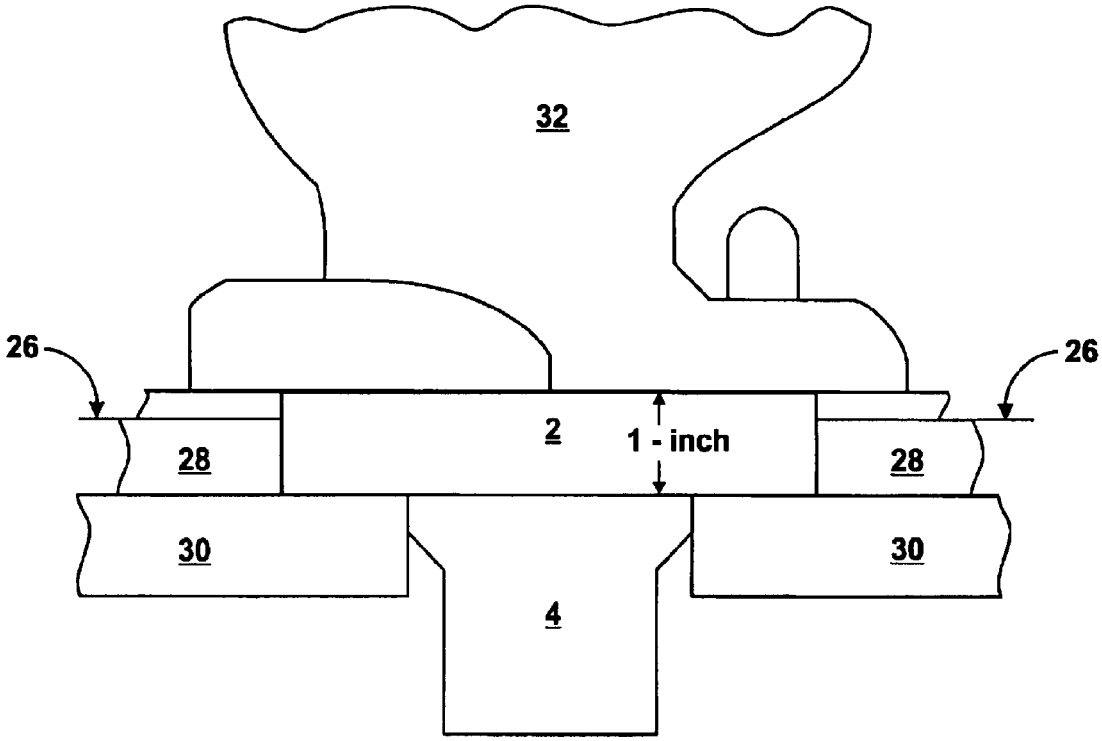
FIG. 1 is a side elevation view of a commode secured to a closet flange in accordance with this invention, the closet flange secured to the base floor, an undergarment layer on top of the base floor, a finish tile floor on top of the undergarment layer, the upper surface of the closet flange being co-planar with said finish tile floor.
Figure 2:
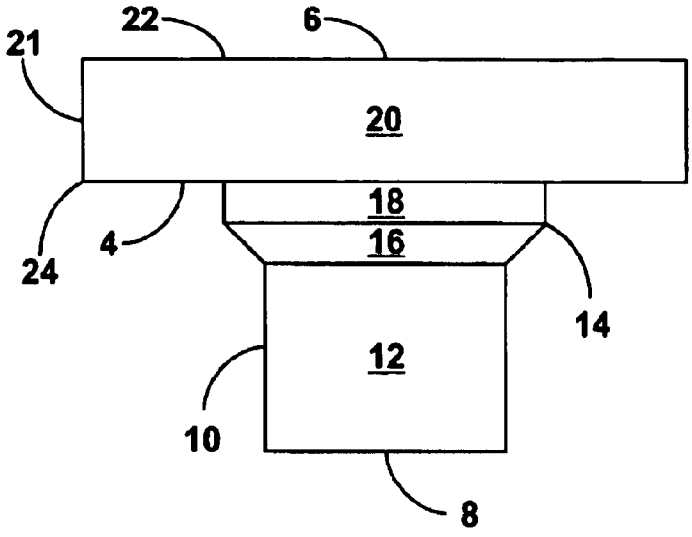
FIG. 2 is a side elevation view of a closet flange in accordance with this invention.
Figure 3:
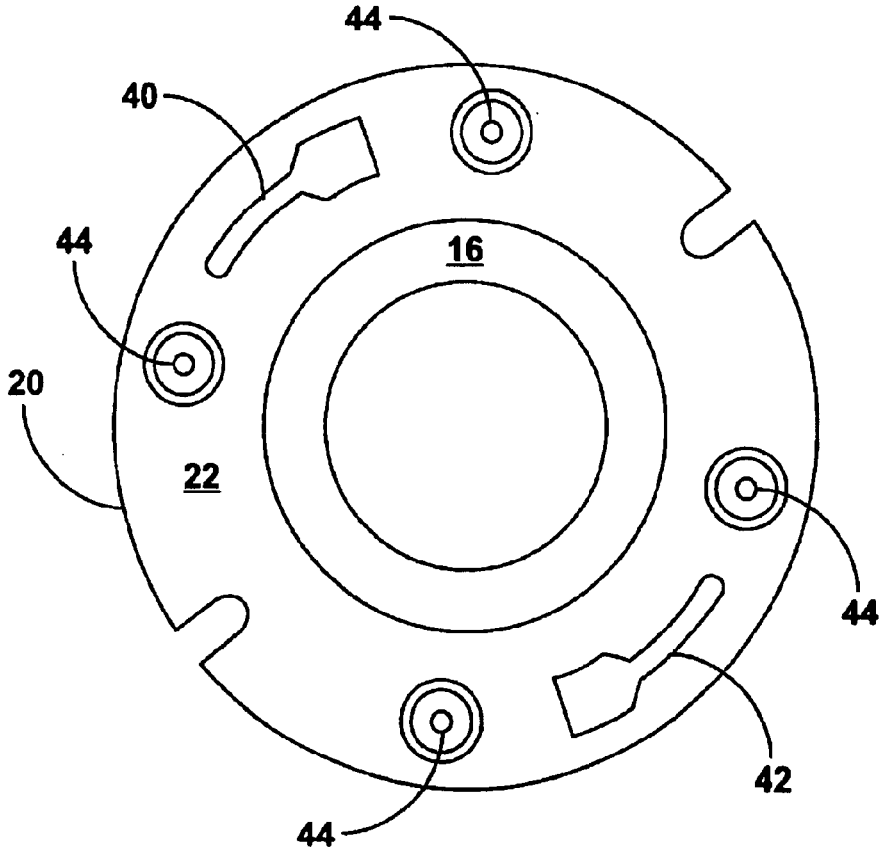
FIG. 3 is a top plan view of a closet flange in accordance with this invention.
Figure 4:
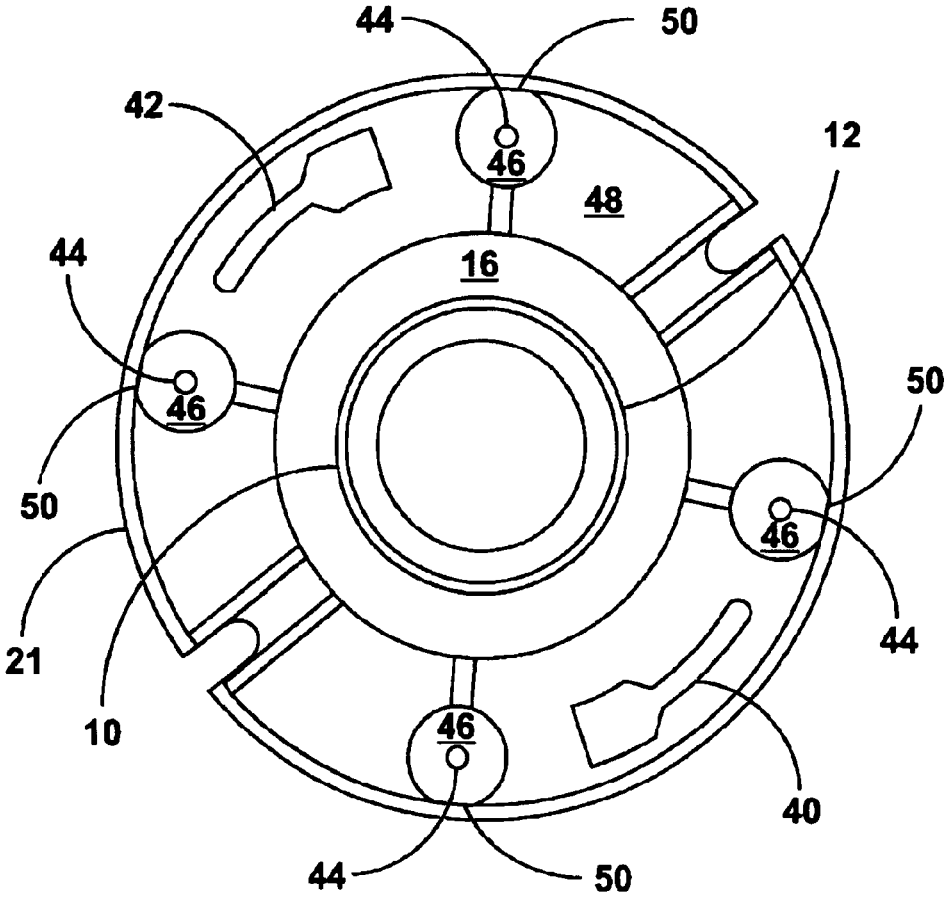
FIG. 4 is a bottom plan view of a closet flange in accordance with this invention.
Figure 5:
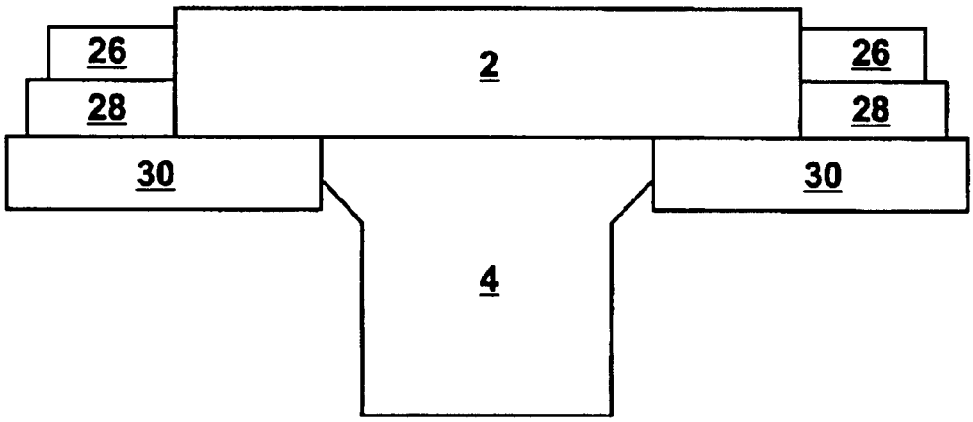
FIG. 5 is a general diagram of another embodiment of a closet flange.

A closet flange 2 in accordance with the present invention comprises an integrally formed support member 4 having an upper end 6 and a lower end 8, a cylindrical portion 10 at the lower end 8 for connection to a discharge conduit, said cylindrical portion having an outer diameter of about four inches and an inner diameter of about three-and-a-half inches, a cylindrical wall 12 extending upwardly from the lower end 8 about one and three-fourths inches, a frusto-conical portion 14 tapering upwardly from the cylindrical wall 12 about one-quarter inch to form a tapered portion 16 to terminate at a cylindrical ring 18 extending upwardly from the tapered portion about one-quarter inch, the cylindrical ring having an outer diameter of about four and a half inches with an inner diameter of about four inches, the cylindrical ring 18 terminating at a relatively wide support flange 20 having an outer diameter of about seven inches and an inner diameter of about four inches. The foregoing dimensions may vary somewhat. For example, the cylindrical portion 10 extending downwardly at the lower end may have a three inch diameter instead of four inch.

The support flange 20 includes a cylindrical side wall 21 which in accordance with the present invention has a vertical dimension between the upper surface 22 of the support flange 20 and the lower edge 24 of the cylindrical side wall 21 that is sufficient to place the upper surface 22 at least level with, or co-planar with, or preferably ¼ inch or ⅜ inch above the finished floor of the bathroom comprising ceramic, marble or other tile 26 on top of the tile supporting undergarment 28, such as Durrock type material also known as Wonder Board type material as well as other types of tile supporting undergarment, which in turn lays on top of the base wood flooring 30, when the lower edge 24 of the cylindrical side wall 21 of the support flange 20 abuts against the surface of the base wood flooring 30 to which the closet flange 2 is bolted. In other words, if the vertical distance between the base wood flooring 30 and the upper surface of the tile 26 on the finished floor will be three-fourths of an inch, the vertical dimension of the cylindrical side wall 21 between the upper surface of the support flange 20 with which the upper edge of the cylindrical side wall is coterminous and its lower edge 24 will also be not less than three-fourths of an inch or greater, and preferably one inch, to avoid the need for washers or other shims under the lower edge 24 to bring the upper surface 22 of the support flange 20 into planar relationship with the upper surface of the tile 26 on the finished bathroom floor or above. The vertical dimension of the cylindrical side wall 21 of the closet flange in accordance with the present invention may be as great as one inch. Prior art closet flanges require the use of shims to bring the upper surface of the flange into co-planar relationship with the upper surface of the tile on the finished floor.

The support flange of prior art closet flanges has a vertical dimension or thickness between the upper surface and the lower surface of about five-sixteenths of an inch to seven sixteenths of an inch. The prior art does not provide a closet flange having a different vertical dimension or thickness than that. Such vertical dimension or thickness is not sufficient to bring the upper surface of prior art closet flanges level with, or co-planar with the upper surface of the finished tile or hardwood floor of the bathroom. Polyvinyl chloride closet flange shims or other shim material have to be placed on top of the prior art flanges in order to raise the level of the upper surface of the prior art flange into co-planar relationship with the surface of the finished tile floor.

The upper surface 22 of the support flange 20 of the closet flange 2 in accordance with this invention has to be co-planar with the surface of the tile 26 on the finished floor of the bathroom or ¼ inch to ⅜ inch above in order to secure the commode 32 itself firmly to the support flange 20 whereby the bottom surfaces of the commode 32 all rest firmly on and against the portions of the floor tile 26 and upper surface 22 of the support flange 20 which the respective portions of the commode 32 are facing. In a typical installation, the combined vertical dimension of the tile 26 and the undergarment 28 above the base wood flooring 30 when laid thereon is more than the five-sixteenth inch to seven-sixteenth inch cylindrical wall thickness of prior art closet flanges by anywhere from one-eighth of an inch to one-fourth of an inch. The closet flange 2 in accordance with the present invention provides a support flange 20 having a cylindrical wall 21 that has a vertical dimension between its upper surface 22 and lower edge 24, or thickness, of any selected dimension between one-sixteenth of an inch to one-fourth of an inch greater than the existing dimension of seven-sixteenths of an inch to one-half inch of prior art closet flanges. For example, a closet flange 2 in accordance with the present invention may have any selected thickness or dimension between its upper surface 22 and the lower surface 24 of its cylindrical wall 21 that is between ninesixteenths of an inch and twelve-sixteenths or three-fourths of an inch, even as much as one inch. The workman who is doing the installation work can then simply measure the distance from the surface of the base wood flooring to the top of the tile 26 laid on top of the undergarment 28, and select the closet flange in accordance with this invention which has the support flange thickness or dimension between upper and lower surfaces of the cylindrical wall 21 thereof that matches the foregoing measurement and calculation.

It is also within the scope of this invention to provide a closet flange having a support flange with a thickness or dimension between the upper surface and lower surface even greater or less than that identified in the preceding paragraph, namely which is whatever thickness or dimension needed to match the vertical dimension between the upper surface of the finished floor material and the base flooring material to which the support flange is secured so as to bring the upper surface 22 of the support flange 20 into co-planar relationship with the upper surface of the finished floor material.

The support flange 20 includes arcuate connecting slots 40 and 42 for connection of the commode 32 to the support flange 20. Four bolt holes 44 are provided through the support flange 20 to bolt it to the floor. Four respective circular bosses 46 are provided on the lower surface 48 of the support flange 20, each circular boss 46 being concentric with a respective one of the bolt holes 44 to provide structural strength and stability at the regions where the support flange 20 is bolted to the floor. Each circular boss 46 terminates downwardly in an end wall 50 that is co-planar with the lower edge 24 of the circular side wall 21, such end walls 50 abutting against the base floor when the closet flange 2 is bolted thereto. The lower surface 48 of the support flange 20 is spaced apart inwardly from the lower edge 24 of the cylindrical wall 21, to provide an annular inset cavity for the latching portion of the connecting bolts of the commode to rotate into locking position after being received through said arcuate connecting slots 40 and 42.

I claim:

1. A closet flange for securing a commode to a floor of a room, the floor having a base floor, an undergarment layer disposed on said base floor and a layer of finish floor material having an upwardly facing surface to extend upwardly from said base floor a first selected dimension, said closet flange comprising:

a connecting member having an upper end and an opposite lower end, a through passageway extending from said upper end to said lower end, a tubular connecting portion at said lower end for connection to a discharge conduit; and a support flange for connection to said base floor and for connection of said commode to said support flange, said support flange having an upper surface, a peripheral side wall having an upper edge coplanar with said upper surface and a spaced apart lower edge, said upper edge of said peripheral side wall being spaced apart from said lower edge thereof a distance that is substantially equal to said first selected dimension;

wherein said upper surface of said support flange must be substantially level with said upwardly facing surface of said finish floor material disposed on the underlayment layer when said support flange is secured to said base floor with said lower edge of said peripheral wall in abutment thereagainst; and wherein the upper surface of the support flange is made substantially level with said unwardly facing surface of said finish floor without use of removable material.

2. The closet flange of claim 1, wherein said first selected dimension is three-fourths of an inch and said upper edge of said peripheral side wall is spaced apart from said lower edge thereof substantially three-fourths of an inch.

3. The closet flange of claim 1, wherein the support flange is secured so as to bring said upper surface of said support flange into co-planar relationship with said upper surface of said finish floor material.

4. The closet flange of claim 1, wherein said upper edge of said peripheral side wall is spaced apart from said lower edge thereof substantially one inch.

5. The closet flange of claim 1, wherein the support flange includes a support member that provides support to the upper surface of the support flange in the direction of the first selected dimension so that floor leveling is accomplished upon installation without use of removable shim material.

6. The closet flange of claim 1, wherein said support flange includes a plurality of bolt holes therethrough to receive blots for securing said support flange to said base floor.

7. The closet flange of claim 1, wherein the upper surface of the flange is positioned slightly above the upwardly facing surface of said finish floor material.

8. A closet flange for installing a bathroom commode, the closet flange comprising:

an integrally formed unit including an upper flange and a cylindrical section extending downwardly from the upper flange for connection to a waste water discharge conduit;

wherein the upper flange has a sufficient thickness to and must lie in substantially the same plane as an upper surface of a finish floor when the closet flange has been secured to a base floor above which a supporting undergarment has been installed with the finish floor installed on the supporting undergarment; and wherein the upper surface of the flange is placed in planar alignment with or slightly above the upper surface of the finish floor without requiring use of removable height adjustment materials.

9. The closet flange of claim 8 wherein the removable height adjustment materials comprise at least one of washers and shim materials.

10. The closet flange of claim 8, wherein the finish floor is a tile floor and the supporting undergarment is a tile supporting undergarment.

11. The closet flange of claim 8, wherein the finish floor is a wood floor.

12. The closet flange of claim 8, wherein the closet flange is bolted to the base floor.

13. The closet flange of claim 8, wherein the upper flange has a thickness of at least ¾ of an inch.

14. The closet flange of claim 8, wherein the combined thickness of the supporting underlayment and the finish floor is greater than ½ of an inch and wherein the upper flange has a thickness greater than ½ of an inch.

15. A method of installing a closet flange having a cylindrical wall with respect to a finish floor having a supporting underlayment, the method comprising:

measuring a combined flooring thickness of the supporting underlayment and the finish floor;

based on the measured combined flooring thickness, selecting a closet flange having a support flange vertical dimension that substantially matches the measured combined flooring thickness, wherein the support flange vertical dimension is defined by a distance between an upper surface of the cylindrical wall of the closet flange and a lower surface of the cylindrical wall of the closet flange; and securing the selected closet flange to a base floor, wherein the supporting the underlayment is disposed on the base floor.

16. The method of claim 15, wherein the measured combined flooring thickness of the supporting undergarment and the finish floor is greater than ½ of an inch and wherein the support flange vertical dimension is greater than ½ of an inch and wherein the support flange vertical dimension is equal to or greater than the measured combined flooring thickness.

17. The method of claim 15, wherein the measured combined flooring thickness of the supporting undergarment and the finish floor is greater than 9/16 of an inch and wherein the support flange vertical dimension is greater than 9/16 of an inch and wherein the support flange vertical dimension is equal to or greater than the measured combined flooring thickness.

18. The method of claim 15, wherein after securing the selected closet flange to the base floor, the upper surface of the closet flange is placed in planar alignment with or slightly above the upper surface of the finish floor without requiring use of washers or shim materials.

* * * * *

UNITED STATES PATENT AND TRADEMARK OFFICE

CERTIFICATE OF CORRECTION

PATENT NO. : 6,751,812 B2
DATED : June 22, 2004
INVENTOR(S) : Mark B. Malloy

It is certified that error appears in the above-identified patent and that said Letters Patent is hereby corrected as shown below:

Column 1,
Lines 31 and 33, “undergarment” should be -- underlayment --.

Column 2,
Lines 7, 9 and 53, “undergarment” should be -- underlayment --.

Column 3,
Lines 5 and 40, “undergarment” should be -- underlayment --.

Column 4,
Lines 35, 36, 45 and 46, “undergarment” should be -- underlayment --.

Column 5,
Line 8, “undergarment” should be -- underlayment --.

Column 6,
Line 2, “undergarment” should be -- underlayment --.

Signed and Sealed this

Twenty-sixth Day of October, 2004

JON W. DUDAS
*Director of the United States Patent and Trademark Office*